US005638159A

United States Patent [19]

Kai et al.

[11] Patent Number: 5,638,159

[45] Date of Patent: Jun. 10, 1997

[54] DEVELOPING UNIT FOR AN IMAGE FORMING APPARATUS AND METHOD OF COLLECTING BICOMPONENT DEVELOPER THEREFROM

[75] Inventors: Tsukuru Kai, Fujisawa; Nobuo Iwata, Sagamihara; Hidetoshi Yano, Yokohama; Yasushi Nakazato, Tokyo; Satoshi Muramatsu, Kawasaki; Yoshiko Ishii, Tokyo; Nobuto Yokokawa, Gotenba; Masako Suzuki, Yokohama, all of Japan

[73] Assignee: Ricoh Company, Ltd., Tokyo, Japan

[21] Appl. No.: 378,726

[22] Filed: Jan. 26, 1995

[30] Foreign Application Priority Data

Jan. 26, 1994 [JP] Japan ..... 6-006989

[51] Int. Cl.[6] ..... G03G 21/00

[52] U.S. Cl. ..... 399/253

[58] Field of Search ..... 355/251, 253, 355/245, 259, 215, 298, 269; 118/656, 657, 658, 651, 653, 645

[56] References Cited

U.S. PATENT DOCUMENTS

| | | | |
|---|---|---|---|
| 4,351,604 | 9/1982 | Karasawa et al. | 118/653 |
| 4,419,960 | 12/1983 | Okamura et al. | 118/712 |
| 4,515,467 | 5/1985 | Suzuki | 118/652 |
| 4,545,325 | 10/1985 | Komatsu et al. | 118/645 |
| 4,571,071 | 2/1986 | Bothner | 430/125 |
| 4,618,243 | 10/1986 | Knapp | 118/645 |
| 5,391,455 | 2/1995 | Bigelow | 430/120 |

FOREIGN PATENT DOCUMENTS

| | | |
|---|---|---|
| 63-118775 | 5/1988 | Japan . |
| 3-31877 | 2/1991 | Japan . |
| 4-9081 | 1/1992 | Japan . |
| 4-114066 | 10/1992 | Japan . |
| 5-181397 | 7/1993 | Japan . |

*Primary Examiner*—Thu A. Dang

*Attorney, Agent, or Firm*—Oblon, Spivak, McClelland, Maier & Neustadt, P.C.

[57] ABSTRACT

A developing unit using a bicomponent developer and capable of collecting only carrier included in the developer and deteriorated due to aging while recycling toner, and a method of collecting the developer from the developing unit. The developing unit separate the developer into toner and carrier before the collection of the developer.

8 Claims, 5 Drawing Sheets

DEVELOPING UNIT FOR AN IMAGE FORMING APPARATUS AND METHOD OF COLLECTING BICOMPONENT DEVELOPER THEREFROM

BACKGROUND OF THE INVENTION

The present invention relates to a developing unit included in an electrophotographic copier, facsimile apparatus, printer or similar image forming apparatus and, more particularly, to a developing unit using a developer consisting of toner and carrier and capable of separating the toner and carrier before collecting the developer, and a method of collecting the developer from the developing unit.

It is a common practice with an image forming apparatus to electrostatically form a latent image representing a document image on the surface of a photoconductive element, or image carrier, develop the latent image by a developer stored in a developing unit, transfer the resulting toner image to a paper, and then fix the toner image on the paper. The developing unit is selectively operable with a monocomponent developer or a bicomponent developer, as customary in the image forming art. The monocomponent developer is charged toner and directly deposited on the surface of the image carrier. The bicomponent developer is a mixture of toner and carrier and has the toner frictionally charged and deposited on the carrier, so that the carrier carrying the toner therewith is supplied to the surface of the image carrier. In both the monocomponent and the bicomponent developers, the toner is repeatedly supplied to the image carrier until it has been deposited on the toner image. Specifically, after the development of the latent image and the following image transfer, the toner remaining on the image carrier is collected by a collecting device for recirculation. Specific constructions of the toner collecting device are disclosed in Japanese Patent Laid-Open Publication No. 57-19774 and Japanese Utility Model Laid-Open Publication No. 4-114066.

Regarding the bicomponent developer, the carrier deteriorates due to aging and, in many cases, causes defective charging to occur. When defecting charging occurs, the toner becomes excessively great in amount and flies about to invite defective images. In such a case, the developer stored in the developing unit is replaced with a fresh developer by a serviceman. Specifically, a serviceman opens, for example, a shutter mounted on the bottom of the casing of the developing unit, removes the used developer, introduces a fresh developer, and the closes the shutter. This, however, brings about a problem that since the whole developer is replaced, even the toner which is still usable is simply discarded. For example, assume that the toner concentration of the developer is 3 wt %, and that 1 kg of developer is stored in the developing unit. Then, the developer contains as much as 30 g of toner. When a document of size A4 and having an image area ratio of 6%, about 150 copies are available with 30 g of toner.

SUMMARY OF THE INVENTION

It is, therefore, an object of the present invention to provide a developing unit capable of collecting only the carrier of a bicomponent developer while recycling usable toner, and a method of collecting the developer from the developing unit.

In accordance with the present invention, in a method of collecting a developer which is a mixture of toner and carrier from a developing unit using the developer, the developer is separated into the toner and carrier and then collected.

Also, in accordance with the present invention, a developing unit using a developer which is a mixture of toner and carrier has a collecting section for collecting the developer, and a separating devide for separating the developer into the toner and the carrier before the collection of the developer.

Further, in accordance with the present invention, a developing unit using a developer which is a mixture of toner and carrier has a collecting section for collecting the developer, and a recycling device for separating the developer into the toner and carrier and then recycling the toner.

Moreover, in accordance with the present invention, a developing unit using a developer which is a mixture of toner and carrier has a collecting device for collecting the developer, a carrier collecting portion for collecting the carrier of the collected developer, and a toner collecting portion for collecting the toner of the collected developer

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENT

Figure 1:
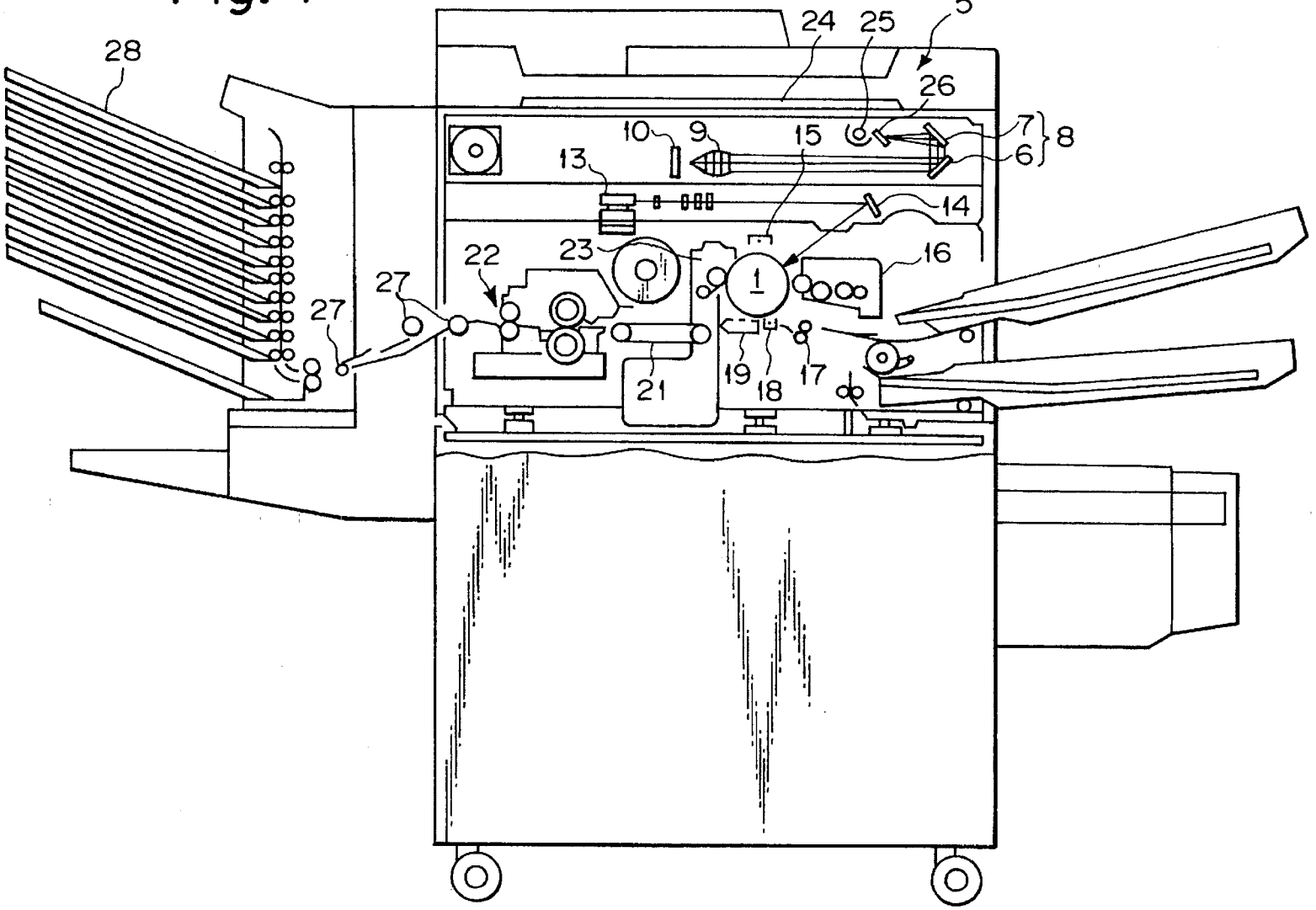
FIG. 1 is a section of an image forming apparatus having a developing unit embodying the present invention.

Referring to FIG. 1 of the drawings, an image forming apparatus is shown which includes a developing unit embodying the present invention. As shown, a photoconductive drum, or image carrier, 1 is located at the center in the housing of the apparatus and made of, for example, an organic photoconductor (OPC). The drum 1 is rotatable about an axis, not shown, extending perpendicularly to the sheet surface of FIG. 1. A glass platen 24 is disposed above the drum 1 and mounted on the top of the housing. First scanning optics 5 having a light source 25 and a mirror and second scanning optics 8 having mirrors 6 and 7 are positioned below the glass platen 24. When a print switch, not shown, is pressed, the two optics 5 and 8 are moved to scan a document laid on the glass platen 24. An image sensor 10 is located at the rear of the lens 9 and generates an image signal representing the scanned document. The image signal is digitized and then processed by a conventional method.

A polygon mirror 13 and a laser diode, not shown, are disposed above and in close proximity to the drum 1. The laser diode is driven on the basis of the processed image signal. A laser beam issuing from the laser diode is reflected by the polygon mirror 13 and then incident to the drum 1 via a mirror 14. The surface of the drum 1 is uniformly charged by a main charger 15 beforehand. As a result, the laser beam electrostatically forms a latent image corresponding to the document image on the charged surface of the drum 1. A developing unit 16 is positioned at one side of the drum 1 and loaded with a bicomponent developer, i.e., a toner and carrier mixture. The developing unit 16 develops the latent image to produce a corresponding toner image. The toner image is transferred to a paper fed from a paper feed section 17 by a transfer charger 18. After the image transfer, a separation charger 19 separates the paper from the surface of the drum 1. Subsequently, the paper is conveyed by a belt 21 to a fixing roller pair 22 to have the toner image fixed thereon. Then, the paper is driven out of the housing to a tray 28. Toner remaining on the drum 1 after the image transfer is removed by a cleaning unit 23.

Figure 2:
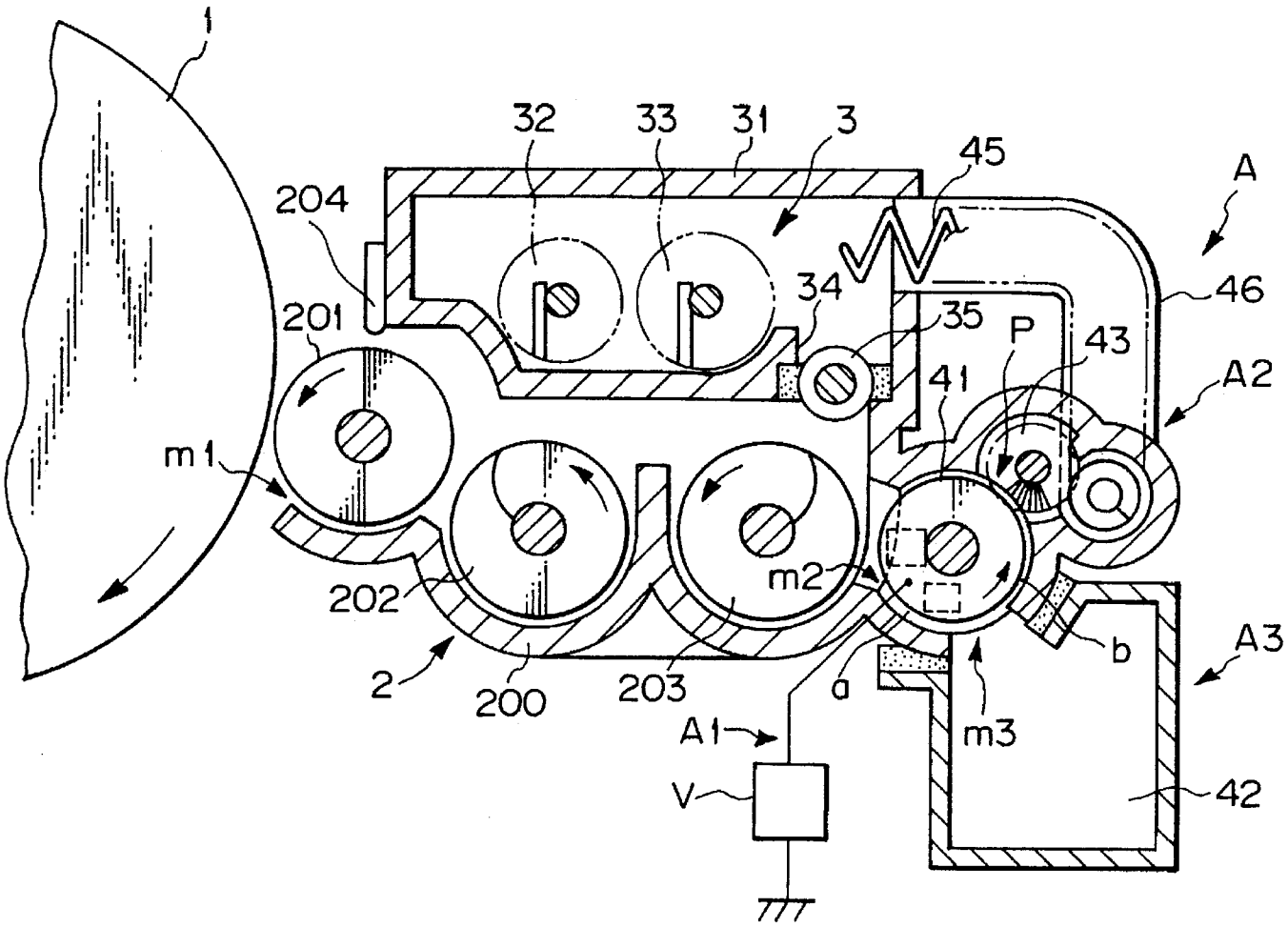
FIG. 2 is an enlarged section of the embodiment.

The developing unit 16 will be described specifically with reference to FIG. 2. As shown, the developing unit 16 is generally made up of a developing section 2, a toner replenishing section 3, and a developer collecting section A. The developing section 2 faces the drum 1 located at the left-hand side as viewed in the figure. The toner replenishing section 3 is disposed above and contiguous with the developing section 2. The developer collecting section A is contiguous with the right portion of the developing section 2 and collects the developer therein.

The developing section 2 has a casing 200 formed with an opening m1 which faces the surface of the drum 1. A developing roller 201 having a magnet roller, a first screw 202 and a second screw 203 are accommodated in the casing 200. The developing roller 201 is positioned in the opening m1. The first screw 202 conveys the developer, which flows along the bottom of the casing 200, in the axial direction of the developing roller 201 while supplying it to the surface of the roller 201. Toner is fed from the toner replenishing section 3 into the casing 200. The second screw 203 introduces the toner into the developer existing in the casing 200, agitates the toner and developer, and drives the resulting mixture toward the first screw 202. The screws 202 and 203 are each rotated counterclockwise (as indicated by an arrow in the figure) about an axis extending perpendicularly to the sheet surface of FIG. 2. The screws 202 and 203 respectively convey the developer to the front and the rear in the direction perpendicular to the sheet surface of FIG. 2. As a result, the developer is circulated at both sides of the casing 200. A doctor 204 is positioned above the developing roller 201 in order to regulate the amount of the developer deposited on the roller 201 and being conveyed toward the drum 1. The part of the developer removed from the roller 201 by the doctor 204 is returned to the bottom of the casing 200 and again fed to the screw 202.

In operation, the developing roller 201 and screws 202 and 203 in the casing 200 are driven by a drive system, not shown. The developer in the casing 200 is agitated in the axial direction of the roller 201 and, at the same time, sequentially delivered to the screws 203 and 202, roller 201, and doctor 204 in this order. On reaching the doctor 204, the developer is divided into two parts, i.e., part to be conveyed to the drum 1 by the roller 201 and part to flow down onto the bottom of the casing 200. The developer returned to the casing 200 is agitated by the screw 202 and again supplied to the surface of the roller 201. Toner fed into the casing 200 from the toner replenishing section 3 is mixed with the developer by the screw 203 while being agitated thereby. The resulting mixture is circulated to the screw 202. In the casing 200, the carrier and toner are mixed together; the toner concentration of the developer is 2 wt % to 10 wt %. A toner concentration sensor, not shown, senses the toner concentration of the developer.

The toner replenishing section 3 has a right casing and a left casing respectively forming a right wall and a left wall, a front wall and a rear wall, not shown, and an openable upper wall. These walls constitute a toner container 31 in combination. Agitators 32 and 33 are disposed in the toner container 31, and each is mounted on a respective rotatable shaft extending perpendicularly to the sheet surface of FIG. 2. The agitators 32 and 33 prevent fresh toner from bridging. The toner agitated by the agitators 32 and 33 accumulate at the right portion of the toner container 31. A toner supply roller 35 is held between opposite pieces of sponge 34 made of polyurethane or similar material. The roller 35 causes the toner to drop from the above-mentioned portion of the toner container 31 into the casing 200 in an amount matching the amount of rotation of the roller 25.

The toner collecting section A has a separating means A1 for separating the developer into the toner and carrier, a toner collecting portion, or recycling means, A2 for recycling the separated toner, and a carrier collecting portion A3. The separating means A1 is made up of a carrier collecting sleeve 41 for collecting the developer existing in the casing 200, magnets M1 and M2 accommodated in the sleeve 41, and a bias power source V for applying a charge opposite in polarity to the toner to the sleeve 41.

The carrier collecting portion A3 has a tank 42 for collecting the carrier, and a gap α formed between the carrier collecting sleeve 41 and the casing 200. The gap α serves to surely guide the developer from the casing 200 to an opening m3 formed through the tank 42.

Figure 3:
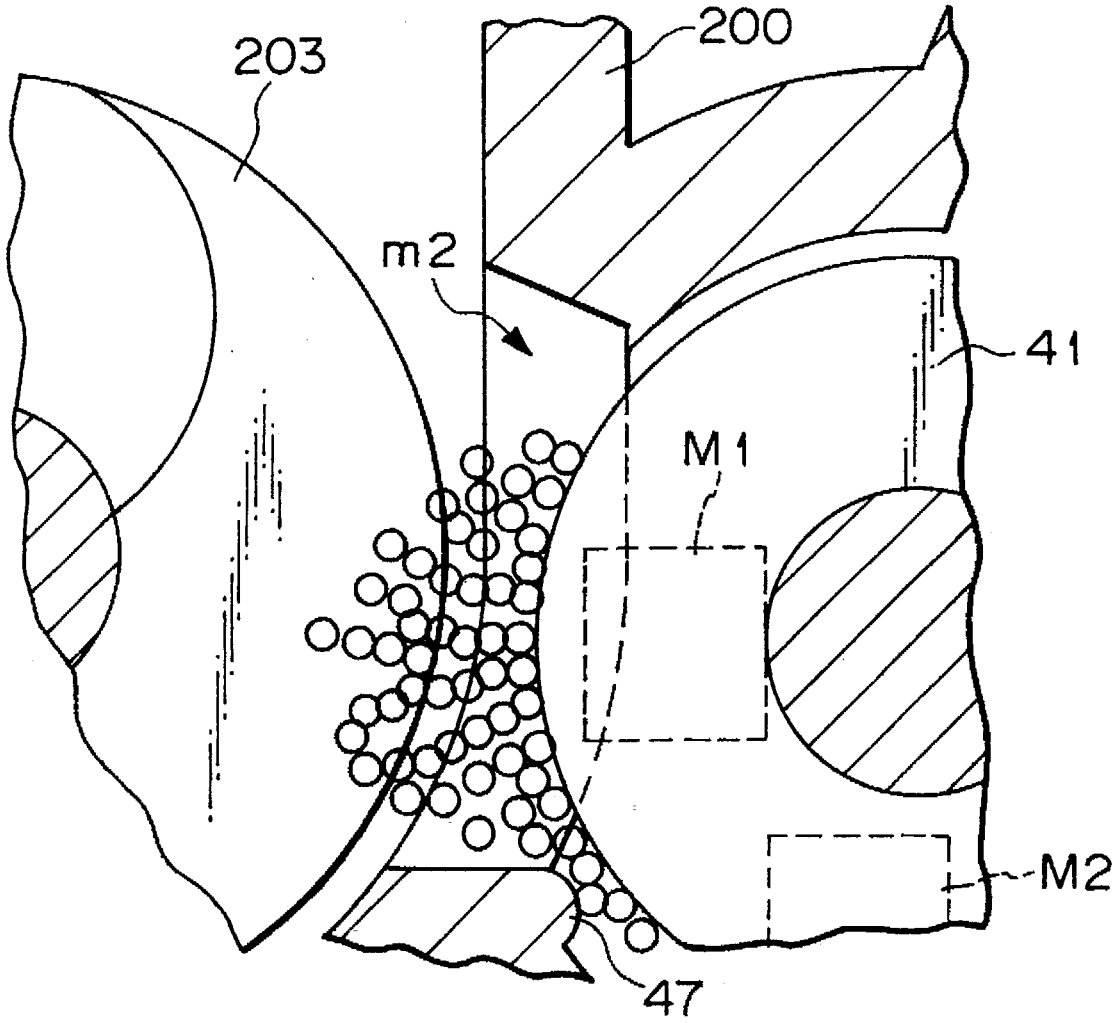
FIG. 3 is a fragmentary enlarged view showing part of a carrier collecting sleeve included in the embodiment and adjoining a conveying screw.

As shown in FIG. 3, the carrier collecting sleeve 41 is located to face the screw 203 disposed in the casing 200. An opening m2 is formed through the side wall of the casing 200, so that the developer in the casing 200 may enter it. Part of the sleeve 41 is movably received in the opening m2. In FIG. 3, only the carrier is shown and represented by circles.

The magnets M1 and M2 received in the carrier collecting sleeve 41 promote the collection of the developer and are fixed in place by supporting means, not shown. The magnets M1 and M2 are arranged such that they magnetically attract the developer onto the surface of the sleeve 41 and surely retain it moving along the gap α. Usually, the sleeve 41 is held in a halt to prevent the carrier, forming a magnet brush due to the magnets M1 and M2, from entering the carrier collecting portion A3.

When the carrier in the developer deteriorates and should be collected, the carrier collecting sleeve 41 is rotated counterclockwise. As shown in FIG. 3, a regulating member 47 protrudes from the inner periphery of the casing 200 into the gap α at the inlet of the gap α. The regulating member 47 prevents the gap α from being locked up or otherwise effected by the developer. A charge opposite in polarity to the toner is applied from the bias power source V to the sleeve 41. As a result, the toner and carrier on the sleeve 41 are separated from each other. The separated toner is retained on the sleeve 41 by an electric force while the separated carrier is retained thereon by a magnetic force. The forces of the magnets M1 and M2 do not act in the opening m3 formed through the tank 42. Hence, the carrier on the sleeve 41 and reached the opening m3 drops from the sleeve 41 into the tank 42. On the other hand, the toner on the sleeve 41 is continuously conveyed to the toner collecting portion A2 due to the electric force, i.e., bias charge.

Figure 4:
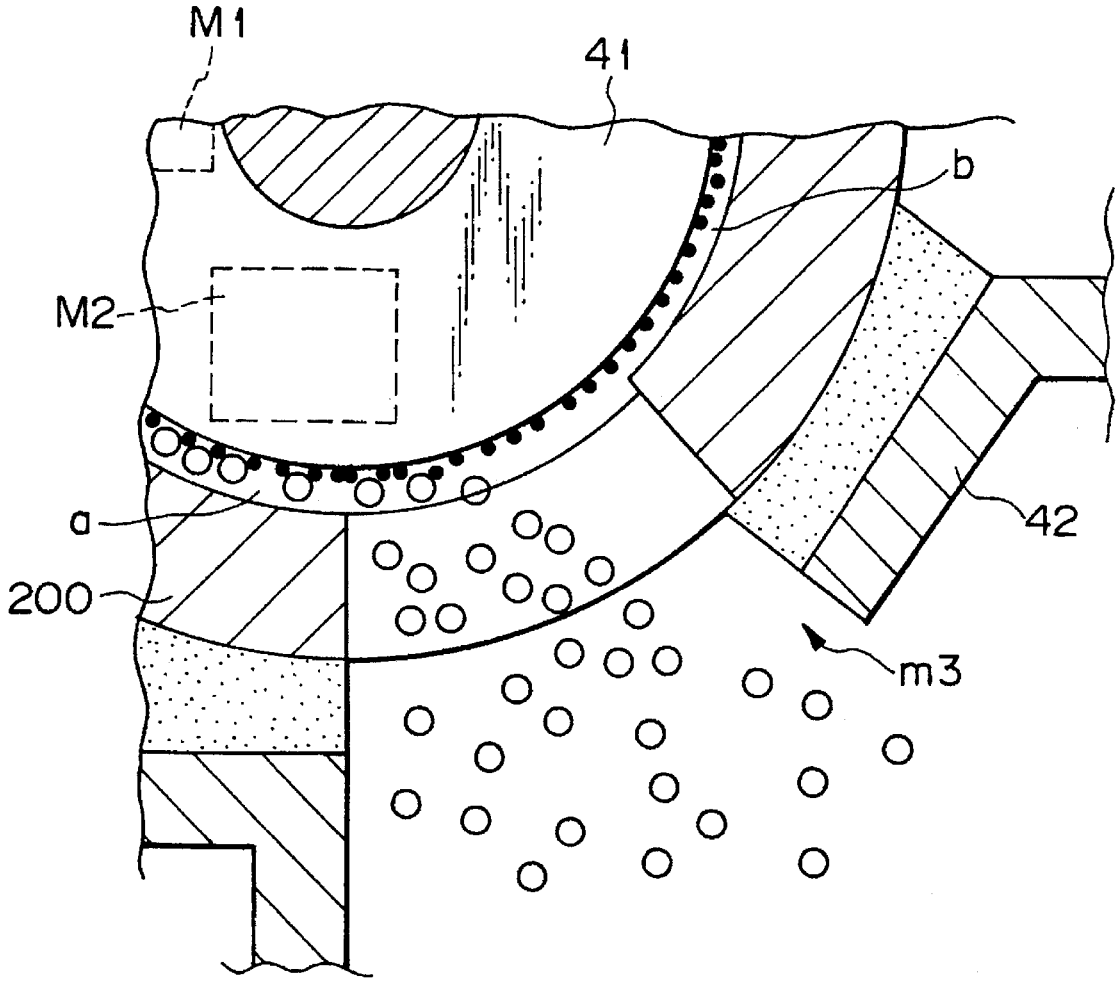
FIG. 4 is a fragmentary enlarged view showing part of the carrier collecting sleeve adjoining a carrier collecting tank.

The toner collecting portion A2 has a fur brush 43 for removing the toner from the sleeve 41, a gap (opening) b formed between the sleeve 41 and the casing, a screw 45, and a bent conduit 46. The gap b guides the developer from the opening m3 to a toner collecting position P where the fur brush 43 is located. The screw 45 and bent conduit 46 cooperate to return the collected toner to the toner replenishing section 3. The gap b is located upstream of the toner collecting position P which faces the fur brush 43. As shown in FIG. 4, the gap b is smaller than the particles size of the carrier (indicated by circles), but it is greater than the particle size of the toner (indicated by dots). In this configuration, part of the carrier remaining on the sleeve 41 even in the range where the magnetism does not act is forcibly removed from the sleeve 41 and collected in the tank 42. As a result, only the toner is left on the sleeve 41 and allowed into the gap b.

Figure 5:
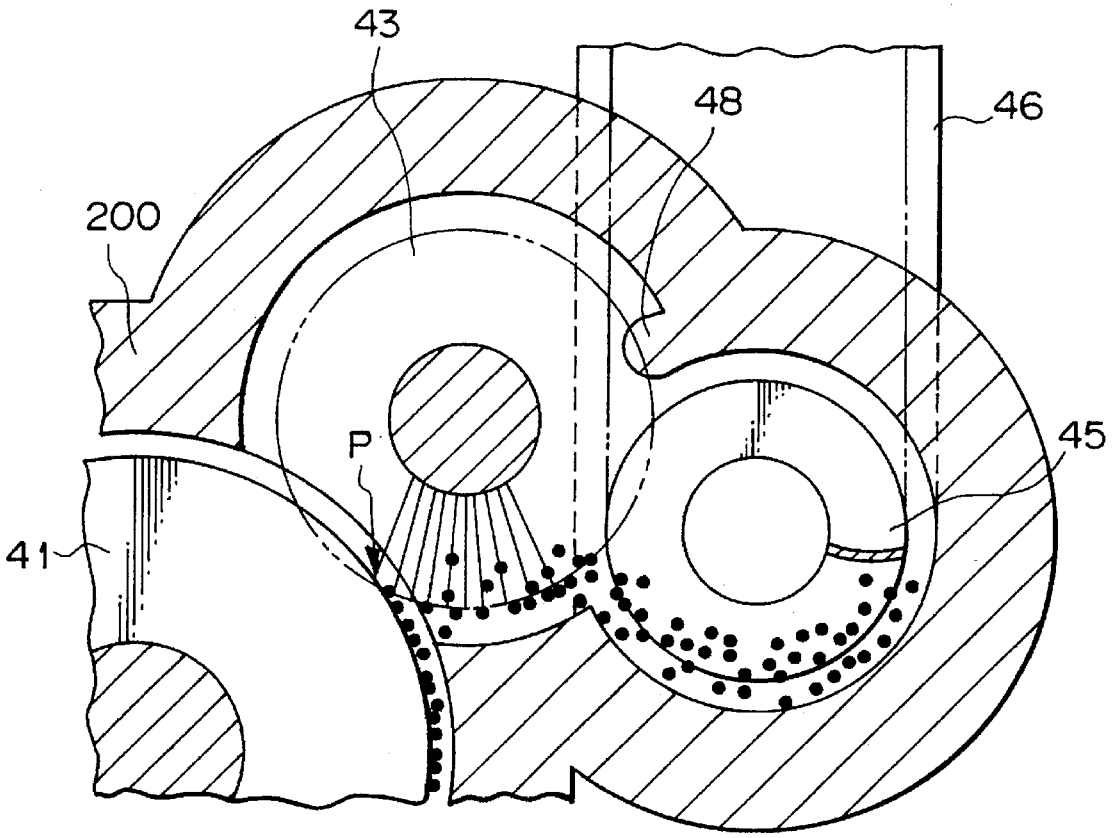
FIG. 5 is a fragmentary enlarged view showing part of the carrier collecting sleeve adjoining a toner collecting screw.

Driven by a drive system, not shown, the fur brush 43 moves in a direction opposite to the direction in which the sleeve 41 moves, as seen in the position where the former contacts the latter. As shown in FIG. 5, when the toner on the sleeve 41 reaches the toner collecting position P, it is removed from the sleeve 41 by the fur brush 43 and conveyed toward the screw 45. A lug 48 protrudes from the inner periphery of the casing 200 and contacts the fur brush 43 at the edge thereof. Hence, the toner on the fur brush 43 is removed from the brush 43 by the lug 48.

Referring again to FIG. 2, the conduit 46 has one or lower opening adjoining the toner collecting position P (see FIG. 5) and the other or upper opening communicating to the casing of the toner container 31. The screw 45 is disposed in the conduit 46 and made of a flexible material. The lower end of the screw 45 is so positioned as to take the toner swept out from the position P into the lower opening of the conduit 46. The screw 45 is rotated by a drive system, not shown, located outside of the casing side wall and has a bend matching the bend of the conduit 46. In this configuration, the toner swept out by the fur brush 43 and reached the screw 45 is returned to the toner container 31 by the screw 45 through the conduit 46.

As stated above, in the illustrative embodiment, the developer separating means A1, toner collecting portion A2 and carrier collecting portion A3 are usually held inoperative. In this condition, the developer forms a magnet brush on the carrier collecting sleeve 41 due to the force of the magnet, thereby preventing the carrier from entering the portion A3.

When the carrier of the developer deteriorates, the developing unit 16 collects it by the following procedure. The carrier collecting sleeve 41 is rotated counterclockwise to convey the developer to the opening m2 of the tank 42 via the gap α. At this instant, a bias charge opposite in polarity to the toner of the developer is deposited on the sleeve 41 so as to separate the carrier and toner on the sleeve 41. The toner and carrier separated from each other are retained on the sleeve 41 by an electric force and a magnetic force, respectively. On reaching the opening m3 of the tank 42 where the magnetic force does not act, only the carrier falls from the sleeve 41 into the tank 42. The toner opposite in polarity to the bias charge and retained on the sleeve 41 is raked off by the fur brush 43 rotating at the toner collecting position P. Then, the toner is returned into the toner replenishing section 3 by the screw 45 through the conduit 46. In this manner, the developer separating means A1 surely separates the toner and carrier from each other. The carrier positively separated from the toner is collected in the carrier collecting portion A3 for removal, while the toner is surely returned to the toner replenishing section 3 as recycled toner. In summary, it will be seen that the present invention has various unprecedented advantages as enumerated below.

(1) Before a bicomponent developer is collected from a developing unit, it is separated into toner and carrier. This allows the collected toner and carrier to be postprocessed with a greater degree of freedom and thereby facilitates the recycling of the toner.

(2) Since means for recycling toner recycles the separated toner, the toner can be effectively used.

(3) Means for applying a charge opposite in polarity to the toner applies such a charge on a developer collecting sleeve included in a developer collecting mechanism. Hence, the toner is surely separated by the sleeve.

(4) A carrier collecting portion and a toner collecting portion are provided independently of each other. Therefore, the toner and carrier can be collected in the respective collecting portions and postprocessed with ease.

(5) Since the carrier collecting portion and toner collecting portion are arranged in this order in the direction of movement of the developer, the toner and carrier can be separated and stored without resorting to a complicated mechanism.

(6) A developer regulating member is located upstream of the carrier collecting portion and guides the developer toward the developer separating means in a constant amount. This allows the separating means to separate the developer into the toner and carrier stably.

(7) An opening smaller than the carrier particle size, but greater than the toner particle size, is located upstream size of the toner collecting portion. This opening insures the separation of the toner and carrier by restricting the movement of the carrier toward the toner collecting section.

Various modifications will become possible for those skilled in the art after receiving the teachings of the present disclosure without departing from the scope thereof.

What is claimed is:

1. A method of collecting a developer to develop images, said developer including a mixture of a toner and a carrier, comprising the steps of:

separating said carrier from said developer;

collecting said carrier;

collecting said toner by passing said toner past an opening located upstream of said developing unit, said opening being smaller than a particle size of the carrier, but greater than a particle size of the toner; and removing said carrier from a supply of developer, whereby the carrier, which may have become deteriorated due to repeated use, is removed from the supply of developer.

2. A developing unit for supplying a developer to develop images, said developer including a mixture of a toner and a carrier, said developing unit comprising:

collecting means for collecting the carrier;

separating means for separating the developer into the toner and the carrier before collection of said carrier;

a toner collecting portion;

an opening in said developing unit located upstream of said toner collecting portion and smaller than a particle size of the carrier, but greater than a particle size of the toner; and removing means for removing said carrier collected by said collecting means from a supply of developer, whereby the carrier, which may have become deteriorated due to repeated use, is removed from the supply of developer.

3. A developing unit as claimed in claim 2, further comprising charging depositing means facing a developer collecting sleeve included in said collecting means, and for depositing a charge opposite in polarity to the toner on said developer collecting sleeve.

4. A developing unit as claimed in claim 2, further comprising a carrier collecting portion for collecting the carrier separated from the toner, and a developer regulating member located upstream of said carrier collecting portion.

5. A developing unit using a developer including a mixture of a toner and a carrier, comprising:

collecting means for collecting the developer;

separating means for separating the developer into the toner and the carrier before collection of said developer;

a toner collecting portion; and an opening in said developing unit located upstream of said toner collecting portion and smaller than a particle size of the carrier, but greater than a particle size of the toner.

6. A developing unit for supplying a developer to develop images, said developer including a mixture of a toner and a carrier, said developing unit comprising:

collecting means for collecting the developer;

recycling means for separating the developer into the toner and the carrier and then recycling said toner;

a toner collecting portion;

an opening in said developing unit located upstream of said toner collecting portion and smaller than a particle size of the carrier, but greater than a particle size of the toner; and removing means for removing said carrier separated by said recycling means from a supply of developer, whereby the carrier, which may have become deteriorated due to repeated use, is removed from the developer supply and the toner is returned to the developer supply.

7. A developing unit for supplying a developer to develop images, said developer including a mixture of a toner and a carrier, said developing unit comprising:

collecting means for collecting the developer;

a carrier collecting portion for collecting the carrier of the collected developer;

a toner collecting portion for collecting the toner of the collected developer;

an opening in said developing unit located upstream of said toner collecting portion and smaller than a particle size of the carrier, but greater than a particle size of the toner; and removing means for removing the collected carrier from a supply of developer, whereby the collected carrier, which may have become deteriorated due to repeated use, is removed from the supply of developer.

8. A developing unit as claimed in claim 7, wherein said carrier collecting portion and said toner collecting portion are arranged in this order in a direction in which the developer is moved.

* * * * *